United States Patent [19]

Sayama

[11] Patent Number: 4,723,502

[45] Date of Patent: Feb. 9, 1988

[54] RUBBER BOAT

[75] Inventor: Tadayoshi Sayama, Tochigi, Japan

[73] Assignee: Okamoto Industries, Inc., Tokyo, Japan

[21] Appl. No.: 947,594

[22] Filed: Dec. 30, 1986

[51] Int. Cl.[4] ..... B63B 7/00

[52] U.S. Cl. ..... 114/345; 441/40

[58] Field of Search ..... 114/345, 352, 354; 441/35, 40, 125-129, 136

[56] References Cited

U.S. PATENT DOCUMENTS

| | | | |
|---|---|---|---|
| 1,456,168 | 5/1923 | Witmer et al. | 441/40 |
| 2,367,835 | 1/1945 | Kreyer | 441/40 |
| 2,464,086 | 3/1949 | Hiscock | 441/35 |
| 4,063,320 | 12/1977 | Neumann et al. | 114/345 |

*Primary Examiner*—Joseph F. Peters, Jr.
*Assistant Examiner*—Jesûs D. Sotelo
*Attorney, Agent, or Firm*—McAulay, Fields, Fisher, Goldstein & Nissen

[57] ABSTRACT

Disclosed herein is a rubber boat including a boat body composed of a ring-shaped air barrel and a bottom cloth which is provided to be spread on the lower surface of the air barrel and has a mounting opening for receiving an air mat; and a boat bottom composed of the air mat. The air mat is fitted into the mounting opening, and the peripheral portion of the air mat and the marginal portion around the mounting opening are connected together by a connecting cord in such a manner as to define a drain space therebetween.

5 Claims, 18 Drawing Figures

RUBBER BOAT

BACKGROUND OF THE INVENTION

1. Field of the Invention

The present invention relates to a rubber boat made of rubber coated fabric and more particularly to a rubber boat mainly used for going down a river.

2. Description of the Prior Art

Conventionally, such a rubber boat has a ring-shaped air barrel composed of a plurality of air chambers of cylindrical configuration in section filled with air, and a boat bottom formed of a bottom cloth which is spread inside of the air barrel at a position higher than the draft level and has a drain port.

Such a rubber boat was developed mainly for fishing or leisure. However, it has been recently employed for going down a river, and especially in a rapid stream, as a large amount of water enters the boat such as by splashing, the boat of the above structure cannot be completely drained. As a larger drain hole for increasing the drain amount causes strength of the bottom cloth to be lowered, the enlargement of the drain hole is limited.

SUMMARY OF THE INVENTION

An object of the present invention is to provide a rubber boat which can increase the absolute amount of drain without lowering strength of the bottom of the boat body.

Another object of the present invention is to provide a rubber boat which increases the bouyancy and can be sufficiently drained when a large amount of water enters the rubber boat.

A further object of the present invention is to provide a rubber boat which can increase the travelling speed by preventing turbulence of the stream at the boat bottom and thereby reducing the resistance produced there.

The invention will become more fully apparent from the claims and the description as it proceeds in connection with the drawings.

DETAILED DESCRIPTION OF PREFERRED EMBODIMENTS

Figure 1:
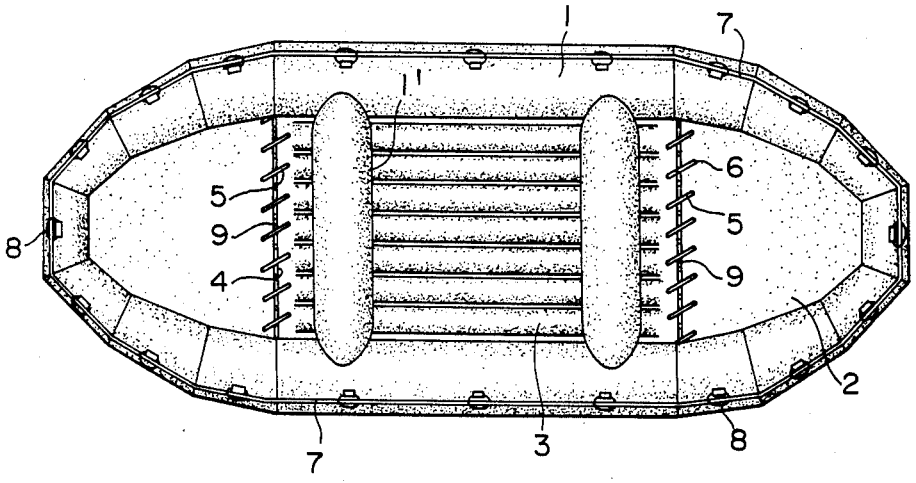
FIG. 1 is a plane view of a rubber boat of a first embodiment according to the present invention.
Figure 2:
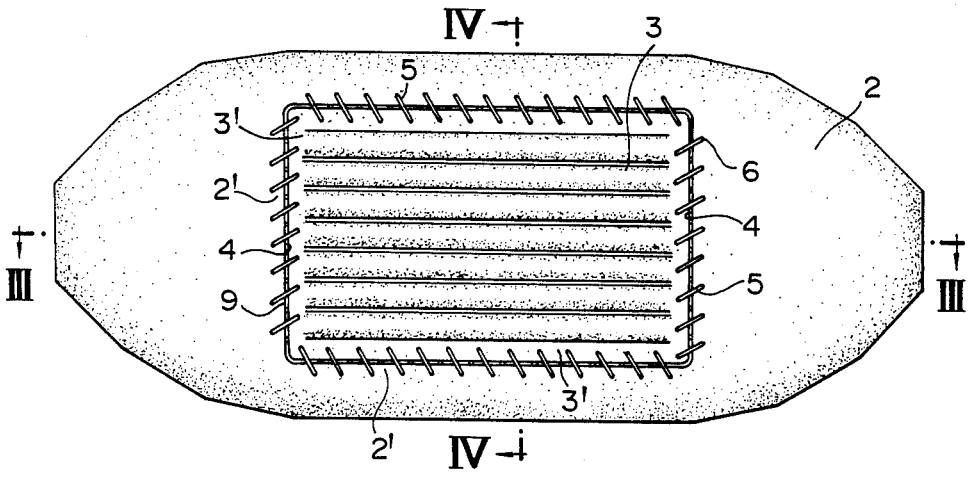
FIG. 2 is a bottom end view of the rubber boat of FIG. 1.
Figure 3:
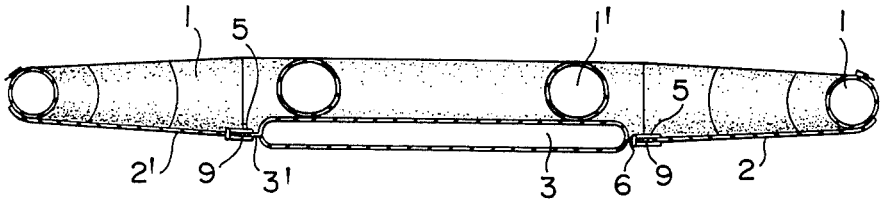
FIGS. 3 and 4 are sectional views of the rubber boat of FIG. 1 taken along lines III—III and IV—IV, respectively.
Figure 4:
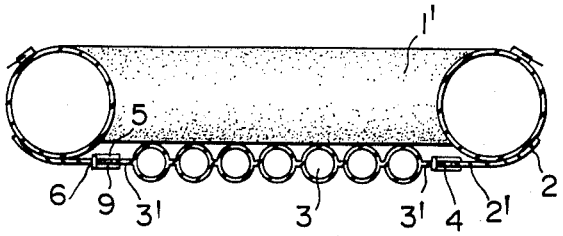
Figure 5:
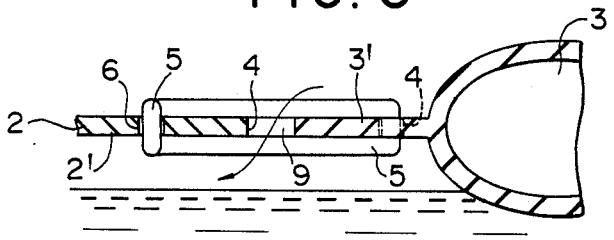
FIG. 5 is an enlarged sectional view of a part of the rubber boat of FIG. 1.

Referring now to FIGS. 1 to 5 wherein the first embodiment of the present invention is shown, a rubber boat body includes an air barrel 1 having a circumferentially disposed endless tube of cylindrical configuration in section made of rubber coated fabric. The interior of the air barrel 1 is divided into a plurality of air chambers. A bottom cloth 2 is provided to be spread on the lower surface of the air barrel 1, and has substantially at the central portion thereof a mounting opening 4 for receiving a boat bottom member 3 composed of an air mat. The marginal portion of the bottom cloth 2 remaining around the mounting opening 4 forms a boat bottom mounting piece 2'. When the air mat 3 is fitted into the mounting opening 4, a projecting piece 3' of the air mat 3 and the mounting piece 2' are connected together by a connecting cord 5. For this purpose, the mounting piece 2' and the projecting piece 3' have reinforcing rings such as grommets secured thereto to define through holes 6 therein at proper intervals. The connecting cord 5 is threaded alternately through the holes 6 of the pieces 2' and 3' to connect them.

The air barrel 1 is provided with as many air inlet ports as the air chambers, and it has on the upper surface a fitting 8 through which a painter or warp 7 can be threaded. Transverse air chambers 1' are detachably or fixedly disposed between both of the longitudinal portions of the air barrel 1.

The mounting opening 4 is a rectangular opening which is substantially as large as or slightly larger than the air mat 3 and is formed in the bottom cloth 2 of rubber coated fabric provided on the lower surface of the air barrel 1 at the central portion leaving the front and rear portions, and the marginal portion of the bottom cloth remaining around the mounting opening 4 forms the boat bottom mounting piece 2'.

The boat bottom member 3 is a rectangular member made of two sheets of rubber coated fabric and having a plurality of long cylindrical air chambers provided in parallel in the widthwise direction, a lug piece 3' formed around the periphery thereof and air inlet ports, and it is, what is called, an air mat having substantially the same shape as the one for leisure. The air mat 3 is fitted into the mounting opening 4 and, as mentioned above, a connecting cord 5 is firmly threaded through the through holes 6 of the mounting piece 2' and the through holes 6 of the lug piece 3' to connect the pieces. At this time, a drain space 9 of a proper width is defined between the marginal portion around the mounting opening 4 or extreme end of the boat bottom mounting piece 2' and the extreme end of the lug piece 3' of the air mat 3.

In the rubber boat thus constructed, even if water enters in the boat body such as by splashing, the air mat 3 can keep its upper surface at a position higher than the water level due to its own buoyancy, and water on the upper surface is eliminated therearound and then drained outside through the drain space 9 located at the position lower than the upper surface of the air mat. This is effected by the bouyancy of the air mat, and if water enters the boat body so much as to stay on the upper surface of the air mat, the inside water level may rise as high as the outside water level and cannot rise higher than the outside water level, the air mat floating up due to its own bouyancy to promote draining effect through the drain space 9. Thus, the rubber boat has a quite advantageous draining characteristic that, as more amount of water enters the boat, more effective drain is achieved.

Furthermore, as the boat bottom mounting piece and the air mat are firmly joined to each other by the connecting cord, there is no reduction of strength of the boat bottom.

Figure 6:
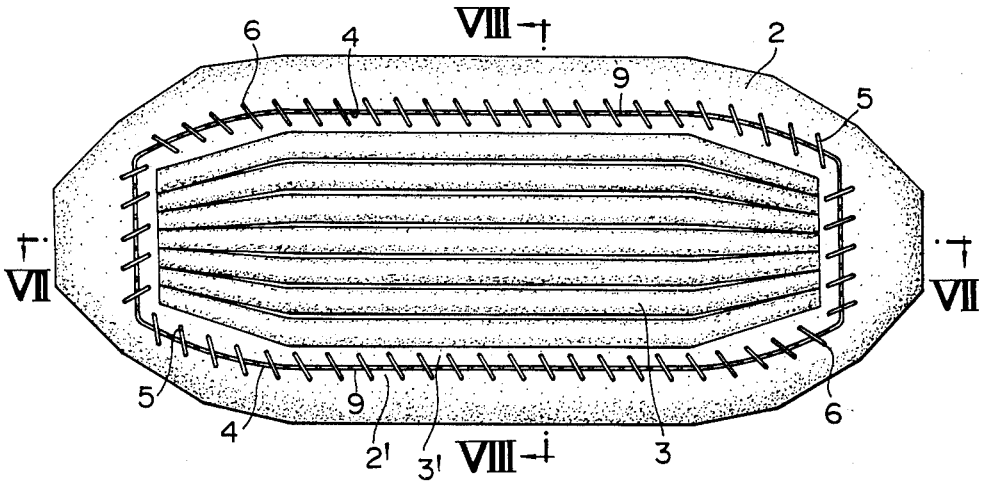
FIG. 6 is a bottom end view of the rubber boat of a second embodiment according to the present invention.
Figure 7:
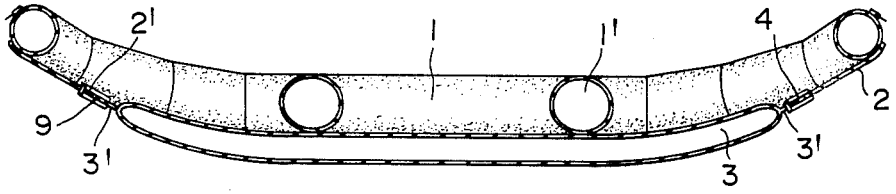
FIGS. 7 and 8 are sectional views of the rubber boat of FIG. 6 taken along lines VII—VII and VIII—VIII, respectively.
Figure 8:
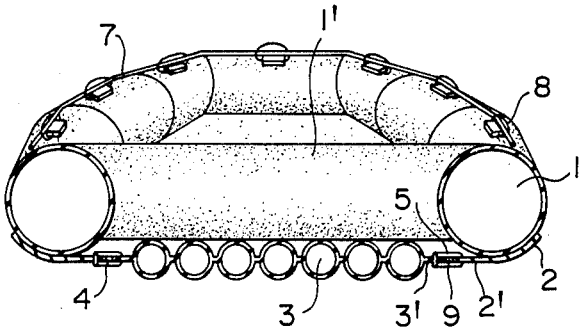
Figure 9:
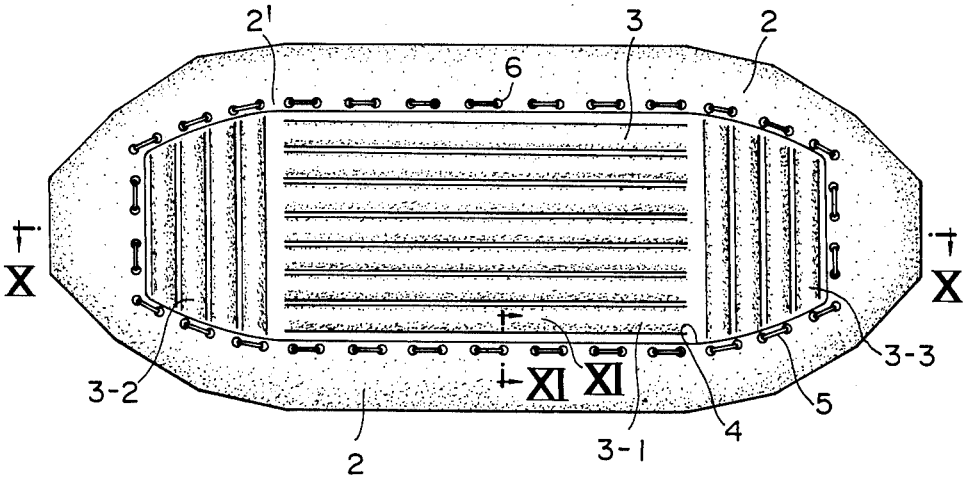
FIG. 9 is a bottom end view of the rubber boat of a third embodiment according to the present invention.
Figure 10:
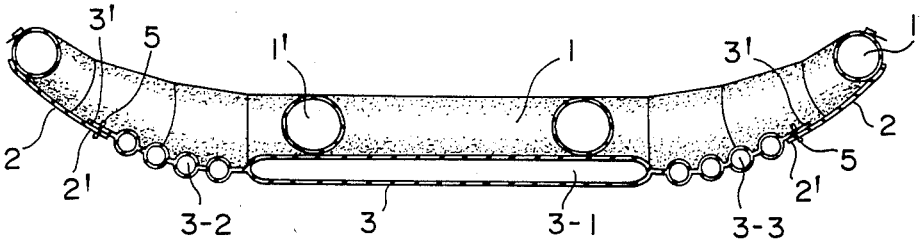
FIG. 10 is a sectional view of the rubber boat of FIG. 9 taken along line X—X.

Now the second embodiment of the present invention will be described with reference to FIGS. 6 to 8. The rubber boat of the second embodiment is basically the same as that of the first embodiment, except that an air barrel 1 is slightly raised at the front and rear portions of a boat body A in such a manner that, as viewed from the side, it is slightly inclined upwardly at the portions. A mounting opening 4 is formed in the whole surface of a bottom cloth 2 including the front and rear portions thereof along the air barrel. An air mat 3 is also inclined upwardly at the front and rear portions thereof in conformity to the inclination of the air barrel, and it has air chambers which become gradually smaller in diameter in the front and rear portions than in the central portion. This structure causes bouyancy at the front and rear portions of the rubber boat body to be reduced to further increase drainage capacity.

FIGS. 9 to 12 show a rubber boat of the third embodiment of the present invention, which is substantially the same as that of the second embodiment and has an air barrel 1 slightly inclined upwardly at the front and rear portions thereof and an mounting opening 4 formed widely in the whole surface of a bottom cloth 2, but the size of the mounting opening 4 and the shape of an air mat 3 are different from those of the second embodiment.

Figure 11:
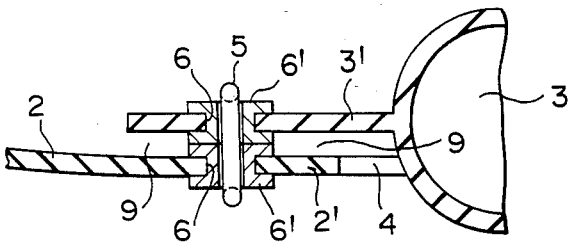
FIG. 11 is an enlarged sectional view of the rubber boat of FIG. 9 taken along line XI—XI.
Figure 12:
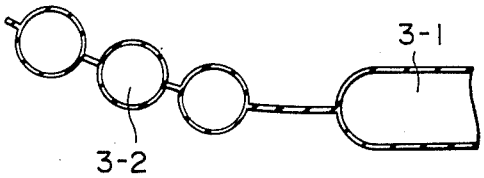
FIG. 12 is an enlarged sectional view of a part of the rubber boat of FIG. 9.

In this embodiment, the mounting opening 4 is formed in a smaller size than the air mat 3, so that a lug piece 3' of the air mat 3 and a boat bottom mounting piece 2' which is the remainder of the bottom cloth 2 overlap each other. A drain space 9 is defined between the lug piece 3' and the mounting piece 2'. For this purpose, reinforcing rings such as grommets secured to the lug piece 3' and the mounting piece 2' to form through holes 6 therein have projecting portions which overlap each other, as shown in FIG. 11, or are positioned in a staggered manner, so that the projecting portions of either piece prevent close contact between the mounting piece 2' and the lug piece 3', assuring provision of the drain space 9. The through holes 6 through which a connecting cord 5 can be threaded serves, at the same time, as drain holes.

As shown in the drawing, the air mat 3 is a unitary member having in the central portion 3-1 thereof air chambers longitudinally extending in parallel to one another and in the inclined front and rear portions 3-2, 3-3 air chambers extending in parallel to one another along the shorter side of the air mat perpendicularly to the longitudinal air chambers. This structure is effective to keep the inclination of the air barrel large, so that, when the boat swings in the fore-and-rear direction, water is ready to gather in the central portion, permitting easy drain.

Figure 13:
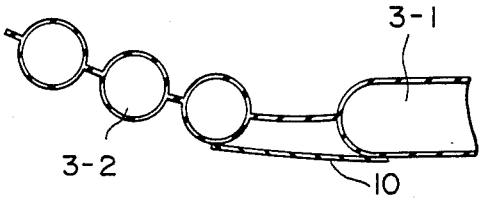
FIG. 13 is a sectional view of a modification of the part of FIG. 12.

FIG. 13 shows a rubber boat which is almost the same as that of the above embodiment except that there are provided straightening covers 10 on the bottom surfaces of the connections between the central portion 3-1 and the front portion 3-2 of the air mat 3 and between the central portion 3-1 and the rear portion 3-3 thereof.

Figure 14:
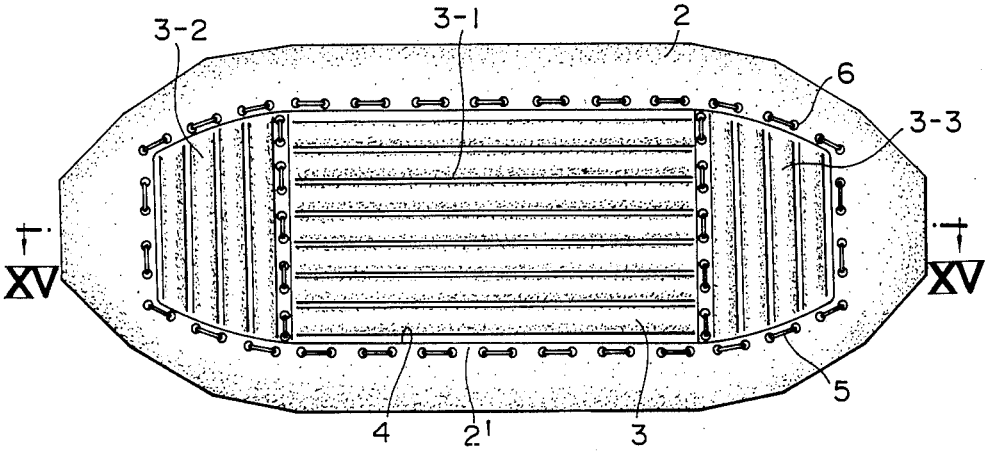
FIG. 14 is a bottom end view of the rubber boat of a fourth embodiment according to the present invention.
Figure 15:
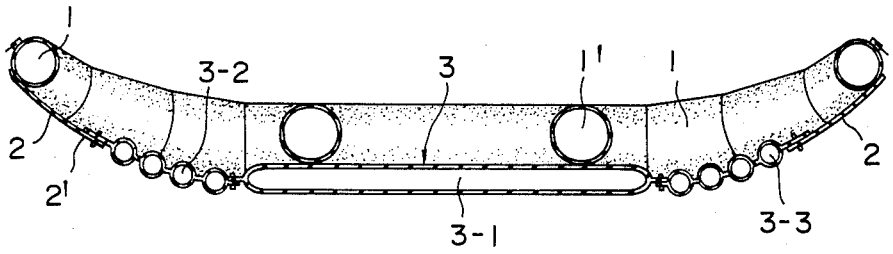
FIG. 15 is a sectional view of the rubber boat of FIG. 14 taken along a line XV—XV.
Figure 16:
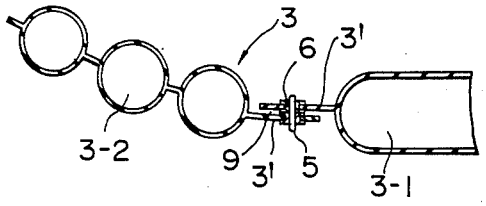
FIG. 16 is an enlarged sectional view of a part of the rubber boat of FIG. 14.

FIGS. 14 to 16 show a rubber boat of the fourth embodiment, which is substantially the same as that of the third embodiment. A lug piece 3' of an air mat 3 and a boat bottom mounting piece 2' overlap each other, and a drain space 9 is defined between the pieces 2' and 3'. In this embodiment, the air mat 3 is composed of three separate members of a central portion 3-1, front portion 3-2 and rear portion 3-3, which are connected together by a connecting cord 5'. The connecting cord 5' is threaded through holes 6' which are substantially the same as the through holes 6 formed in the air mat 3 and the mounting piece 2'.

In the rubber boat thus constructed, the air mat is not a large unitary member but separated into three small members which are economical because of ease in manufacturing and simple to handle. As these members are firmly interconnected by the connecting cord, there is no reduction of strength of the boat bottom.

Figure 18:
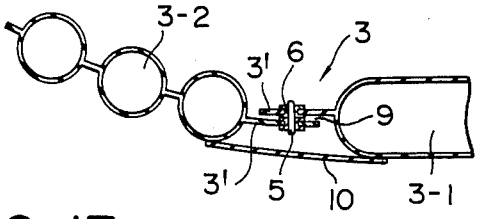
FIG. 18 is an enlarged sectional view of a part of the rubber boat of FIG. 18.
Figure 17:
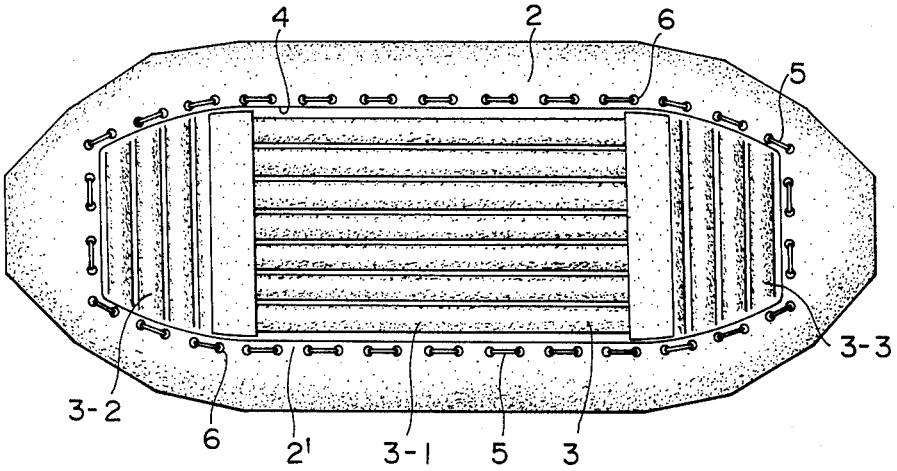
FIG. 17 is a bottom end view of a modification of the rubber boat of the fourth embodiment.

FIGS. 17 and 18 show a rubber boat which has straightening covers 10 attached to the connections between the central portion 3-1 and the front portion 3-2 of the air mat 3 and between the central portion 3-1 and the rear portion 3-3, like that in FIG. 13.

The straightening covers 10 are strip members made of rubber coated fabric, and they are employed to cover unevenness formed at the connections or joints between the central portion 3-1 and the front and rear portion 3-2 and 3-3 of the air mat 3. The straightening covers 10 are attached between the central portion and the front and rear portions, with either longer side adhered to the corresponding portion, to smooth the uneven connections in a flat manner. Synthetic resin fabric may be used instead of rubber coated fabric, and the cover 10 may be adhered not on both sides of the cover 10 but only at predetermined locations such as on the front side in the advancing direction. What is essentially required is to prevent intrusion of water flow into the uneven connections or joints.

In the above structure in which the straightening covers are provided at the connections or joints between the central portion and front and rear portions of the air mat, the uneven connections can be covered to be flattened, causing no turbulance of water flowing along the boat bottom. Thus, water flows smoothly, and consequently resistance is reduced to increase the travelling speed.

Though not shown in the drawing, the straightening covers may be provided not only between the central portion and the front and rear portions but also between the air mat and the air barrel.

It is mentioned that the first embodiment has a characteristic that bouyancy of the air mat produces the draining effect and entrance of water into the boat will not cause reduction of drainage but, on the contrary, increase the drainage effect due to the bouyancy. It will be apparently understood that this property is not limited to the first embodiment but also imparted to the other embodiments.

What is claimed is:

1. A rubber boat comprising a boat body including a bottom cloth which has a mounting opening and a mounting piece surrounding said mounting opening; and a boat bottom member composed of an air mat having a peripheral lug piece extending beyond said opening and overlapping said mounting piece which is adapted to be connected with said mounting piece by a connecting cord in such a manner as to define a drain space between said mounting piece and said air mat.

2. A rubber boat comprising a boat body including an air barrel which is upwardly inclined at the front and rear portions and a bottom cloth which is spred on said air barrel and has a mounting opening formed substantially in the whole surface of said bottom cloth along said air barrel and a mounting piece surrounding said mounting opening; and an air mat having air chambers and adapted to be fitted into said mounting opening, the air chambers being smaller in diameter in the front and rear portions of said air mat than in the central portion thereof, said air mat having a lug piece adapted to be connected with said mounting piece by a connecting cord in such a manner as to define a drain space between said mounting piece and said air mat; said lug piece overlapping said mounting piece for connection together by said connecting cord in the drain space between said mounting piece and said lug piece of the air mat.

3. The rubber boat as claimed in claim 2, wherein said air mat is provided with straightening covers attached to the bottom surfaces of the connections between the central portion and the front and rear portions.

4. A rubber boat comprising a boat body including an air barrel which is upwardly inclined at the front and rear portions and a bottom cloth which is spread on said air barrel and has a mounting opening formed substantially in the whole surface of said bottom cloth along said air barrel and a mounting piece surrounding said mounting opening; and an air mat which is separated into front, central and rear members, said central member including air chambers extending longitudinally, said front and rear members including air chambers extending along the shorter side, all of said members being connected together by a connecting cord and fitted into said mounting opening, said air mat having a lug piece adapted to overlap said mounting piece to be connected together by a connecting cord in such a manner as to define a drain space between said mounting piece and said lug piece of the air mat.

5. A rubber boat comprising a boat body including an air barrel which is upwardly inclined at the front and rear portions and a bottom cloth which is spread on said air barrel and has a mounting opening formed substantially in the whole surface of said bottom cloth along said air barrel and a mounting piece surrounding said mounting opening; and an air mat which is separated into front, central and rear members, said central member including air chambers extending longitudinally, said front and rear members including air chambers extending along the shorter side, all of said members being connected together by a connecting cord and fitted into said mounting opening, said air mat having a lug piece adapted to overlap said mounting piece to be connected together by a connecting cord in such a manner as to define a drain space between said mounting piece and said lug piece of the air mat; said air mat being provided with straightening covers attached to the bottom surfaces of the connections.

* * * * *